US007807228B2

(12) United States Patent
Fujieda

(10) Patent No.: US 7,807,228 B2
(45) Date of Patent: Oct. 5, 2010

(54) METHOD OF FORMING LUSTER COATING FILM

(75) Inventor: Tsukasa Fujieda, Yokohama (JP)

(73) Assignee: Kansai Paint Co., Ltd., Amagasaki-Shi (JP)

( * ) Notice: Subject to any disclaimer, the term of this patent is extended or adjusted under 35 U.S.C. 154(b) by 466 days.

(21) Appl. No.: 10/576,277

(22) PCT Filed: Oct. 20, 2004

(86) PCT No.: PCT/JP2004/015484

§ 371 (c)(1),
(2), (4) Date: Apr. 18, 2006

(87) PCT Pub. No.: WO2005/037448

PCT Pub. Date: Apr. 28, 2005

(65) Prior Publication Data

US 2007/0128369 A1 Jun. 7, 2007

(30) Foreign Application Priority Data

Oct. 21, 2003 (JP) ..... 2003-360199

(51) Int. Cl.
*B05D 3/02* (2006.01)

(52) U.S. Cl. ..... 427/385.5; 427/205

(58) Field of Classification Search ..... 427/385.5
See application file for complete search history.

(56) References Cited

U.S. PATENT DOCUMENTS

| | | | | |
|---|---|---|---|---|
| 4,820,555 | A * | 4/1989 | Kuwajima et al. | 427/407.1 |
| 5,079,030 | A | 1/1992 | Tomioka et al. | |
| 5,320,673 | A * | 6/1994 | Carpenter | 106/404 |
| 5,378,275 | A * | 1/1995 | Shiraga et al. | 106/417 |

FOREIGN PATENT DOCUMENTS

| | | | |
|---|---|---|---|
| JP | 61-74679 | | 4/1986 |
| JP | 62-33578 | | 2/1987 |
| JP | 62-33578 | A | 2/1987 |
| JP | 6-51160 | | 7/1994 |
| JP | 6-51160 | B | 7/1994 |
| JP | 9-1050 | | 1/1997 |
| JP | 9-141195 | | 6/1997 |
| JP | 9-141195 | A | 6/1997 |
| JP | 2913703 | | 4/1999 |
| JP | 11-300239 | | 11/1999 |
| JP | 11-300239 | A | 11/1999 |
| JP | 2001149857 | A * | 6/2001 |
| JP | 2001-347223 | | 12/2001 |
| JP | 2001-347223 | A | 12/2001 |
| JP | 2002-86057 | | 3/2002 |
| JP | 2002-102798 | | 4/2002 |
| JP | 2002-102798 | A | 4/2002 |
| JP | 2002-273333 | | 9/2002 |
| JP | 2002-273333 | A | 9/2002 |
| JP | 2003-117481 | A | 4/2003 |
| JP | 2003117481 | A * | 4/2003 |

OTHER PUBLICATIONS

Japanese Office Action dated Aug. 19, 2009.

* cited by examiner

*Primary Examiner*—Michael Barr
*Assistant Examiner*—Robert S Walters, Jr.
(74) *Attorney, Agent, or Firm*—Kratz, Quintos & Hanson, LLP

(57) ABSTRACT

The present invention provides:

luster coating film forming method I comprising (1) applying an aqueous luster thermosetting base coating composition (A) to a substrate in three to five stages, in such a manner that the thickness of the base coating composition (A) applied in each of the second and subsequent stages becomes 0.3 to 5 μm when cured; (2) applying a thermosetting clear coating (B) over the uncured or heat-cured coating layer of the base coating composition (A); and (3) heating the two-layer coating comprising the base coating composition (A) and clear coating composition (B) to obtain a cured two-layer coating film; and luster coating film forming method II comprising the above steps (1) to (3) and further including the step of applying and curing a thermosetting clear coating composition (C).

8 Claims, No Drawings

METHOD OF FORMING LUSTER COATING FILM

BACKGROUND OF THE INVENTION

1. Field of the Invention

The present invention relates to a method of forming a luster coating film on a substrate.

2. Description of Related Art

Luster coating films usually contain flaky luster pigments, such as aluminum flakes, mica flakes, etc., and have various color tones. Such luster coating films shine brilliantly as the luster pigments reflect incident light from outside the coating films, and exhibit a unique and variable aesthetic appearance achieved by the combination of the reflected light and the color tones of the coating films.

In recent years, luster coating films, in particular those formed on automotive bodies or the like, are being required to exhibit high-quality appearance characteristics, such as a highly dense texture, high flip-flop property, etc. As used herein, dense texture means uniform, continuous luster created by a luster pigment in a coating film. A highly dense texture can be achieved when a coating film has little graininess caused by the luster pigment contained therein. Flip-flop property is produced by the orientation of the flaky luster pigment in a coating film, parallel to the coating film surface. A coating film with that property reflects light well and has high brightness in the highlight (i.e., when viewed from the front), but has low brightness in the shade (i.e., when viewed at an angle). That is, flip-flop property is a property that produces a difference in brightness depending on the angle of vision.

Japanese Unexamined Patent Publication No. 2002-273333 discloses a method of forming a luster coating film, in which a luster base coating is formed on a substrate in two stages, followed by forming a clear coating, the thickness ratio of the base coating composition applied in the first stage to that applied in the second stage being 2/1 to 4/1. This method can prevent unevenness in the luster of luster coating films.

However, especially when an aqueous luster base coating composition is used, the above method is likely to result in insufficient orientation of the flaky luster pigment used, and is not capable of forming a luster coating film with a highly dense texture and high flip-flop property.

DETAILED DESCRIPTION OF THE INVENTION

Problems to be Solved by the Invention

An object of the present invention is to provide a method capable of forming on a substrate a luster multilayer coating film with a highly dense texture and high flip-flop property, using an aqueous luster base coating composition.

Means for Solving the Problems

The present inventors conducted extensive research to achieve the above object, and found that the object can be achieved by applying an aqueous luster thermosetting base coating composition to a substrate in three to five stages, followed by application of a thermosetting clear coating composition. The present invention was accomplished based on this new finding.

The present invention provides the following luster coating film forming methods.

1. A method of forming a luster coating film, comprising the steps of:

(1) applying an aqueous luster thermosetting base coating composition (A) to a substrate in three to five stages, in such a manner that the thickness of the base coating composition (A) applied in each of the second and subsequent stages becomes 0.3 to 5 μm when cured;

(2) applying a thermosetting clear coating composition (B) over the uncured or heat-cured coating layer of the base coating composition (A); and (3) heating the two-layer coating comprising the base coating composition (A) and clear coating composition (B) to obtain a cured two-layer coating film.

2. The method according to item 1, wherein the aqueous luster thermosetting base coating composition (A) comprises a water-soluble or water-dispersible, crosslinkable functional group-containing resin, a crosslinking agent and a flaky luster pigment.

3. The method according to item 1, wherein, in step (1), the thickness of the aqueous luster thermosetting base coating composition (A) applied in the first stage is 0.3 to 9 μm (when cured).

4. The method according to item 1, wherein, in step (1), the solids content of the aqueous luster thermosetting base coating composition (A) one minute after the application in each stage is at least 40 wt. %.

5. The method according to item 1, wherein the substrate is an automotive body or a part thereof.

6. An automotive body or part thereof having a luster coating film formed by the method according to item 5.

7. A method of forming a luster coating film, comprising the steps of:

(1) applying an aqueous luster thermosetting base coating composition (A) to a substrate in three to five stages, in such a manner that the thickness of the base coating composition (A) applied in each of the second and subsequent stages becomes 0.3 to 5 μm when cured;

(2) applying a thermosetting clear coating composition (B) over the uncured or heat-cured coating layer of the base coating composition (A);

(3) applying a thermosetting clear coating composition (C) over the uncured or heat-cured coating layer of the clear coating composition (B); and (4) heating the three-layer coating comprising the base coating composition (A), clear coating composition (B) and clear coating composition (C) to obtain a cured three-layer coating film.

8. The method according to item 7, wherein the aqueous luster thermosetting base coating composition (A) comprises a water-soluble or water-dispersible, crosslinkable functional group-containing resin, a crosslinking agent and a flaky luster pigment.

9. The method according to item 7, wherein, in step (1), the thickness of the aqueous luster thermosetting base coating composition (A) applied in the first stage is 0.3 to 9 μm (when cured).

10. The method according to item 7, wherein, in step (1), the solids content of the aqueous luster thermosetting base coating composition (A) one minute after the application in each stage is at least 40 wt. %.

11. The method according to item 7, wherein the substrate is an automotive body or a part thereof.

12. An automotive body or a part thereof having a luster coating film formed by the method according to item 11.

The method of forming a luster coating film according to the present invention is described below in detail.

Substrate

Usable substrates include bodies of automobiles and motorcycles, parts thereof, etc. Usable substrates further include metal materials that form such bodies and the like, such as cold rolled steel sheets, galvanized steel sheets, zinc alloy-plated steel sheets, stainless steel sheets, tinned steel sheets and other steel sheets, aluminum sheets, aluminum alloy sheets, magnesium sheets, magnesium alloy sheets, etc.; plastic substrates; and the like.

Also usable are such bodies, parts and metal materials whose metal surface has been subjected to a chemical conversion treatment, such as phosphate treatment, chromate treatment or the like. Further, such bodies, metal materials, etc., for use as substrates may be coated with an undercoat such as a cationic electrodeposition coating, or with such an undercoat and an intermediate coat, or with such an undercoat, an intermediate coat, and a colored base coat applied over the intermediate coat.

Aqueous Luster Thermosetting Base Coating Composition (A)

In the method of the present invention, an aqueous luster thermosetting base coating composition (A) is applied to a substrate to form a first coating layer. The base coating composition (A) preferably comprises a water-soluble or water-dispersible, crosslinkable functional group-containing resin, a crosslinking agent and a flaky luster pigment. The base coating composition (A) may also be a coating composition comprising a self-crosslinking resin, such as a blocked isocyanate-containing polyester resin, and a flaky luster pigment.

Examples of water-soluble or water-dispersible, crosslinkable functional group-containing resins include acrylic resins, polyester resins and polyurethane resins, all having crosslinkable functional group(s) such as hydroxy group(s), carboxyl group(s), etc.; grafts of such resins; and the like. Among these, hydroxy-containing acrylic resins, hydroxy-containing polyester resins and the like are especially preferable. Such hydroxy-containing resins preferably have a hydroxy value of about 1 to about 200 mgKOH/g.

Examples of water-soluble or water-dispersible, hydroxy-containing acrylic resins include hydroxy- and carboxy-containing acrylic copolymers obtained by copolymerizing a monomer mixture comprising a carboxyl-containing unsaturated monomer or like hydrophilic group-containing unsaturated monomer, a hydroxy-containing unsaturated monomer, and other unsaturated monomers. Such an acrylic copolymer preferably has a number average molecular weight of about 3,000 to about 100,000, and more preferably about 5,000 to about 50,000.

The number average molecular weight as used herein is determined by converting the molecular weight measured by gel permeation chromatography, based on the molecular weight of polystyrene.

Examples of carboxy-containing unsaturated monomers include (meth)acrylic acid, crotonic acid and other monocarboxylic acids; maleic acid, fumaric acid, itaconic acid and other dicarboxylic acids; half monoalkyl esters of dicarboxylic acids; etc. These may be used singly or in combination.

Examples of hydroxy-containing unsaturated monomers include 2-hydroxyethyl(meth)acrylate, 2-hydroxypropyl (meth)acrylate, 3-hydroxypropyl(meth)acrylate, 4-hydroxybutyl(meth)acrylate and other hydroxyalkyl esters of acrylic acid and methacrylic acid, and the like. These may be used singly or in combination.

Examples of other unsaturated monomers include methyl (meth)acrylate, ethyl(meth)acrylate, n-propyl(meth)acrylate, i-propyl(meth)acrylate, n-butyl(meth)acrylate, i-butyl(meth) acrylate, t-butyl(meth)acrylate, 2-ethylhexyl(meth)acrylate, cyclohexyl(meth)acrylate, lauryl(meth)acrylate, isobornyl (meth)acrylate and other $C_{1-24}$ alkyl esters and cycloalkyl esters of acrylic acid and methacrylic acid; and glycidyl (meth)acrylate, acrylonitrile, acrylamide, dimethylaminoethyl methacrylate, styrene, vinyltoluene, vinyl acetate, vinyl chloride, 1,6-hexanediol diacrylate, etc. These may be used singly or in combination.

Mixtures of such monomers can be copolymerized by known methods, such as emulsion polymerization, solution polymerization, etc.

When the acrylic copolymer is an acrylic emulsion obtained by emulsion polymerization, the acrylic emulsion may be an emulsion of multilayer particles, obtained by multistage emulsion polymerization of a monomer mixture in the presence of water and an emulsifier.

If necessary, the carboxy groups in the acrylic copolymer may be neutralized with a basic substance. Preferable examples of the basic substance are those soluble in water, such as ammonia, methylamine, ethylamine, propylamine, butylamine, dimethylamine, trimethylamine, triethylamine, ethylenediamine, morpholine, methylethanolamine, dimethylethanolamine, diethanolamine, triethanolamine, diisopropanolamine, 2-amino-2-methylpropanol, etc. These may be used singly or in combination.

Water-soluble or water-dispersible, hydroxy-containing polyester resins can be obtained by neutralizing the carboxy groups of an oil-free or oil-modified, hydroxy- and carboxy-containing polyester resin prepared by an esterification reaction using a polyhydric alcohol and polybasic acid, optionally together with a monobasic acid, oil component (or fatty acid), etc. Such a polyester resin preferably has a number average molecular weight of about 500 to about 50,000, and more preferably about 3,000 to about 30,000.

Examples of polyhydric alcohols include ethylene glycol, diethylene glycol, propylene glycol, butanediol, pentanediol, hexanediol, 2,2-dimethylpropanediol, ethylene oxide adducts of bisphenol compounds, propylene oxide adducts of bisphenol compounds and other diols; glycerin, trimethylolpropane, pentaerythritol and other triols and higher polyols; and the like. These may be used singly or in combination.

Examples of polybasic acids include phthalic acid, isophthalic acid, tetrahydrophthalic acid, hexahydrophthalic acid, maleic acid, succinic acid, adipic acid, sebacic acid and other dibasic acids, and anhydrides thereof; trimellitic acid, pyromellitic acid and other tribasic and higher polybasic acids, and anhydrides thereof; and the like. These may be used singly or in combination.

Examples of monobasic acids include benzoic acid, t-butylbenzoic acid, etc. These may be used singly or in combination.

Examples of oil components include castor oil, dehydrated castor oil, safflower oil, soybean oil, linseed oil, tall oil, coconut oil, fatty acids of such oils, etc. These may be used singly or in combination.

Carboxy groups can be introduced into polyester resins by, for example, combined use of a dibasic acid and a tribasic or higher polybasic acid as a polybasic acid; addition of a dicarboxylic acid to hydroxy groups of a polyester resin by half esterification; or like methods. Hydroxy groups can be introduced into polyester resins by, for example, combined use of a diol and a triol or higher polyol as a polyhydric alcohol; or like methods.

Carboxy groups of such a polyester resin can be neutralized with the above-mentioned basic substances. It is usually preferable to perform neutralization before adding the crosslinking agent and pigment.

In order to improve the chipping resistance of the coating film to be obtained, the aqueous luster thermosetting base coating composition (A) may contain a water-soluble or water-dispersible polyurethane resin.

The polyurethane resin can be prepared, for example, as follows. First, a urethane prepolymer is synthesized by polymerizing diisocyanate, polyether diol and/or polyester diol, a low-molecular-weight polyhydroxy compound and a dimethylolalkanoic acid, in such a proportion that the NCO/OH equivalent ratio is 1.1 to 1.9, by a single- or multi-stage process in the presence or absence of a hydrophilic organic solvent containing no active hydrogen groups in its molecule. The urethane prepolymer, after or while being neutralized with a tertiary amine, is mixed with water so as to effect emulsification dispersion in water simultaneously with chain extension. Then, if necessary, the organic solvent is distilled off to thereby obtain an aqueous dispersion of a polyurethane resin.

Examples of hydrophilic organic solvents containing no active hydrogen groups in their molecule include acetone, methyl ethyl ketone, ethylene glycol monobutyl ether, etc. These may be used singly or in combination.

Examples of usable isocyanates include aliphatic diisocyanates and alicyclic diisocyanates. Specific examples include hexamethylene diisocyanate, 2,2,4-trimethylhexane diisocyanate, lysine diisocyanate and other aliphatic diisocyanates; 1,4-cyclohexane diisocyanate, 1-isocyanato-3-isocyanatomethyl-3,5,5-trimethylcyclohexane (isophorone diisocyanate), 4,4'-dicyclohexylmethane diisocyanate, isopropylidene dicyclohexyl-4,4'-diisocyanate and other alicyclic diisocyanates; modified products of such diisocyanates; etc. Examples of modified products of diisocyanates include carbodiimide-modified diisocyanates, uretdione-modified diisocyanates, uretimine-modified diisocyanates, etc. These may be used singly or in combination.

It is preferable to use a polyether diol and/or polyester diol with a number average molecular weight of about 500 to about 5,000, and more preferably about 1,000 to about 3,000.

Examples of such polyether diols and polyester diols include polyethylene glycol, polypropylene glycol, polyethylene-propylene block glycol, polyethylene-propylene random glycol, polytetramethylene ether glycol, polyhexamethylene ether glycol, polyhexamethylene ether glycol, polyoctamethylene ether glycol and other glycols; polyethylene adipate, polybutylene adipate, polyhexamethylene adipate, polyneopentyl adipate, poly-3-methylpentyl adipate, polyethylene/butylene adipate, polyneopentyl/hexyl adipate and other adipates; polycaprolactone diol, poly-3-methylvalerolactone diol, polycarbonate diol and other ester diols; etc. These may be used singly or in combination.

The low-molecular-weight polyhydroxy compound preferably has a number average molecular weight less than 500. Specific examples include glycols and other dihydric alcohols, and low-mole alkylene oxide adducts thereof; glycerol, trimethylolethane, trimethylolpropane and other trihydric alcohols, and low-mole alkylene oxide adducts thereof; etc. These may be used singly or in combination. The proportion of the low-molecular-weight polyhydroxy compound to the polyether diol and/or polyester diol is preferably about 0.1 to about 20 wt. %, and more preferably about 0.5 to about 10 wt. %.

Examples of dimethylolalkanoic acids include dimethylolacetic acid, dimethylolpropionic acid, dimethylolbutyric acid, etc. These may be used singly or in combination. The proportion of the dimethylolalkanoic acid to the polyether diol and/or polyester diol is preferably about 0.5 to about 5 wt. %, and more preferably about 1 to about 3 wt. %.

Examples of tertiary amines usable for neutralization of the urethane prepolymer include trimethylamine, triethylamine, triisopropylamine, tri-n-propylamine, tri-n-butylamine and other tertiary amines; N-methyl morpholine, N-ethyl morpholine and other morpholine amines; N-dimethylethanolamine, N-diethylethanolamine and other alkanolamines; etc. These may be used singly or in combination.

Crosslinking agents that can be preferably used in the aqueous luster thermosetting base coating composition (A) include, for example, blocked polyisocyanates, amino resins, phenol-formaldehyde resins, etc. Such crosslinking agents may be water-soluble or hydrophobic.

Melamine resins can be preferably used as amino resins. Preferable melamine resins include, for example, those obtained by etherifying methylol groups of methylolated melamines with $C_{1-8}$ monohydric alcohols. When preparing such etherified melamine resins, all of the methylol groups of methylolated melamines may be etherified, or part thereof may be etherified, with methylol group(s) and/or imino group(s) remaining. Such melamine resins may be hydrophilic or hydrophobic. When using a hydrophobic melamine resin, it is preferable to mix the resin with an aqueous dispersant resin before use.

Specific examples of etherified melamine resins include methyl etherified melamines, ethyl etherified melamines, butyl etherified melamines and other alkyl etherified melamines. Such etherified melamine resins can be used singly or in combination.

The proportions of the water-soluble or water-dispersible, crosslinkable functional group-containing resin and the crosslinking agent are, based on solids, preferably about 50 to about 90 wt. % of the former and about 50 to about 10 wt. % of the latter, and more preferably about 60 to about 80 wt. % of the former and about 40 to about 20 wt. % of the latter, relative to the total weight of the resin and agent.

Examples of flaky luster pigments usable in the aqueous luster thermosetting base coating composition (A) include aluminum flakes, metal oxide-covered alumina flakes, metal oxide-covered silica flakes, graphite pigments, metal oxide-covered mica, titanium flakes, stainless steel flakes, plate-like iron oxide pigments, metal-plated glass flakes, metal oxide-covered glass flakes, holographic pigments, etc. Such pigments can be used singly or in combination.

The flaky luster pigment to be used preferably has a mean particle diameter of about 5 to about 50 μm, and more preferably about 5 to about 30 μm. The mean thickness of the flaky luster pigment is preferably about 0.01 to about 2 μm, and more preferably about 0.05 to about 1.5 μm. The ratio of the mean particle diameter to the mean thickness is preferably about 5 to about 500, and more preferably about 20 to about 300.

The amount of the flaky luster pigment to be added is preferably about 1 to about 50 parts by weight, and more preferably about 5 to about 30 parts by weight, per 100 parts by weight of the total solids of the crosslinkable functional group-containing resin and crosslinking agent.

The aqueous luster thermosetting base coating composition (A) may further contain, if necessary, a coloring pigment and/or dye.

Examples of coloring pigments include titanium dioxide, carbon black, zinc white, molybdenum red, Prussian blue, cobalt blue, phthalocyanine pigments, azo pigments, quinacridone pigments, isoindoline pigments, threne pigments, perylene pigments, etc. These may be used singly or in combination.

Examples of dyes include azo dyes, anthraquinone dyes, indigoid dyes, carbonium dyes, quinoneimine dyes, phthalocyanine dyes, etc. These may be used singly or in combination.

When using a coloring pigment and/or dye, the amount thereof is preferably about 0.1 to about 50 parts by weight, and more preferably about 1 to about 30 parts by weight, per 100 parts by weight of the total solids of the crosslinkable functional group-containing resin and crosslinking agent.

The aqueous luster thermosetting base coating composition (A) may further contain, if necessary, paint additives, such as organic solvents, curing catalysts, coating surface conditioners, pigment dispersants, rheology control agents, ultraviolet absorbers, light stabilizers, antioxidants, antifoaming agents, etc.

The aqueous luster thermosetting base coating composition (A) can be prepared by mixing the components described above. Pigments may be mixed with a dispersant resin or the like to form a paste before use. Water or a mixed solvent of water and an organic solvent is used as the medium.

Known organic solvents can be used in the coating composition (A), including, for example, ester solvents, ketone solvents, ether solvents, alcohol solvents, etc. These may be used singly or in combination. It is especially preferable to use a hydrophilic organic solvent such that at least 50 parts by weight of the solvent is dissolved in 100 parts by weight of water at 20° C.

The solids content of the coating composition (A) is not limited, and is preferably about 5 to about 40 wt. % at the time of application of the coating composition, to achieve excellent film-forming properties.

Thermosetting Clear Coating Compositions (B) and (C)

In the method of the present invention, a thermosetting clear coating composition (B) is applied over an uncured or cured coating layer of the base coating composition (A). Further, a thermosetting clear coating composition (C) is applied over an uncured or cured coating layer of the clear coating composition (B).

The thermosetting clear coating compositions (B) and (C) may be any of the known organic solvent-based or aqueous coating compositions, as long as they can form coating layers that are sufficiently transparent to allow the underlying luster coating layer of the coating composition (A) to be seen therethrough. The clear coating compositions (B) and (C) may be the same or different.

Usable thermosetting clear coating compositions include those comprising a base resin, a crosslinking agent therefor, and an organic solvent and/or water as a medium, and further containing, if necessary, a coloring pigment, luster pigment, dye, ultraviolet absorber, light stabilizer, etc.

Examples of base resins include acrylic resins, polyester resins, alkyd resins, fluorine resins, urethane resins, silicon-containing resins, etc., all containing crosslinkable functional group(s), among which crosslinkable functional group-containing acrylic resins are especially preferable. Such resins contain at least one crosslinkable functional group such as a hydroxy group, carboxy group, silanol group, epoxy group and/or the like.

Usable crosslinking agents are those capable of reacting with crosslinkable functional group(s) in the base resin. Specific examples include melamine resins, urea resins, polyisocyanate compounds, blocked polyisocyanate compounds, epoxy compounds, carboxy-containing compounds, acid anhydrides, alkoxysilane-containing compounds, etc.

The proportions of the base resin and crosslinking agent are, based on solids, preferably about 50 to about 90 wt. % of the former and about 50 to about 10 wt. % of the latter, and more preferably about 65 to 80 wt. % of the former and about 45 to about 20 wt. % of the latter, relative to the total weight of the resin and agent.

The thermosetting clear coating compositions may further contain, if necessary, paint additives such as curing catalysts, coating surface conditioners, rheology control agents, antioxidants, defoaming agents, waxes, etc.

Steps for Forming Coating Film

The coating film-forming method of the present invention encompasses two embodiments: method I comprising the steps of applying the aqueous luster thermosetting base coating composition (A) to a substrate in three to five stages, and subsequently applying the thermosetting clear coating composition (B); and method II comprising the above steps and further the step of applying the thermosetting clear coating composition (C).

Specifically, method I comprises the steps of:

(1) applying the aqueous luster thermosetting base coating composition (A) to a substrate in three to five stages, in such a manner that the thickness of the coating composition applied in each of the second and subsequent stages becomes 0.3 to 5 μm (when cured).

(2) optionally heat-curing the base coating composition (A) and applying the thermosetting clear coating composition (B) over the uncured or heat-cured coating layer of the base coating composition (A); and (3) heating the two-layer coating comprising the base coating composition (A) and clear coating composition (B) to obtain a cured two-layer coating film.

In step (1), the aqueous luster thermosetting base coating composition (A) is applied to a substrate in three to five stages. The base coating composition (A) is applied in three to five stages using a coater, such as a rotary electrostatic coater, air spray coater, airless spray coater or the like. After each coating stage, the applied composition may be allowed to stand for about 0.5 to about 3 minutes, or may be preheated at about 50 to about 80° C. for about 1 to about 10 minutes in order to promote evaporation of moisture. It is preferable to adjust, for application in each stage, the solids content of the base coating composition (A) to about 5 to about 40 wt. %, and more preferably about 5 to about 15 wt. %. In the final stage, it is especially preferable to adjust the solids content of the composition to about 5 to about 15 wt. %.

The solids content of the base coating composition (A) one minute after the application in each stage is preferably at least about 40 wt. %, and more preferably about 50 to about 80 wt. %, so that the flaky luster pigment is easily orientated parallel to the coating surface.

The solids content of the composition one minute after the application can be determined, for example, as follows. First, the base coating composition (A) is applied over a predetermined area of aluminum foil under the same conditions as above. After 1 minute, the coated aluminum foil is recovered, immediately folded so that the moisture does not further evaporate and immediately weighed. The aluminum foil is then opened, and the coating composition is cured under the same conditions as the heat-curing conditions for the multilayer coating, and weighed. The solids content of the applied composition is calculated from these weights and the weight of the aluminum foil measured beforehand.

It is essential that the thickness of the base coating composition (A) applied in each of the second and subsequent stages be about 0.3 to about 5 μm (when cured), and preferably about 1 to about 4 μm (when cured). When the thickness is less than 0.3 μm, the applied composition may be unable to sufficiently hide the underlying surface, whereas when the thickness is more than 5 μm, the moisture may not sufficiently evaporate, making it difficult for the flaky luster pigment to be orientated parallel to the coating surface.

The thickness of the base coating composition (A) applied in the first stage is preferably about 0.3 to about 9 μm (when cured), and more preferably about 1 to about 8 μm (when cured).

The total thickness of the base coating composition (A) applied in all of the stages in step (1) is preferably about 7 to about 20 μm (when cured), and more preferably about 10 to about 15 μm (when cured).

In step (2), without curing or after heat-curing the coating layer of the base coating composition (A) formed in step (1), the thermosetting clear coating composition (B) is applied over the coating layer of the base coating composition (A). When the coating layer of the coating composition (A) is heat-cured before application of the clear coating composition (B), it is usually suitable to heat the coating layer at about 60 to about 210° C., and preferably about 100 to about 180° C., for about 10 to about 60 minutes.

The clear coating composition (B) is applied using a coater such as a rotary electrostatic coater, air spray coater, airless spray coater or the like. The thickness of the coating layer of the clear coating composition (B) is preferably about 15 to about 50 μm (when cured), and more preferably about 25 to about 40 μm.

In step (3), the two-layer coating comprising the base coating composition (A) and clear coating composition (B) is heated to obtain a cured two-layer coating film. It is usually suitable to perform heat curing at about 60 to about 210° C., and preferably about 100 to about 180° C., for about 10 to about 60 minutes.

When the coating layer of the base coating composition (A) has already been cured, only the uncured coating layer of the clear coating composition (B) is cured in step (3). In this case, method I is a two-coat two-bake method. Alternatively when the coating layer of the base coating composition (A) has not been cured, the uncured coating layers of the base coating composition (A) and clear coating composition (B) are simultaneously cured. In this case, method I is a two-coat one-bake method.

Method II for forming a luster coating film specifically comprises:

(1) applying the aqueous luster thermosetting base coating composition (A) to a substrate in three to five stages, in such a manner that the thickness of the base coating composition (A) applied in each of the second and subsequent stages becomes 0.3 to 5 μm (when cured);

(2) optionally heat-curing the base coating composition (A) applying the thermosetting clear coating (B) over the uncured or heat-cured coating layer of the base coating composition (A);

(3) optionally heat-curing the clear coating composition (B) and applying a thermosetting clear coating composition (C) over the uncured or heat-cured coating layer of the clear coating composition (B); and (4) heating the three-layer coating comprising the base coating composition (A), clear coating composition (B) and clear coating composition (C) to obtain a cured three-layer coating film.

Steps (1) and (2) are the same as those of method I.

In step (3), without curing or after heat-curing the coating layer of the clear coating composition (B) formed in step (2), the thermosetting clear coating composition (C) is applied over the coating layer of the clear coating composition (B).

When the uncured coating layer of the coating composition (B) is heat-cured before applying the clear coating composition (C), it is usually suitable to heat the coating layer at about 60 to about 210° C., and preferably about 100 to about 180° C., for about 10 to about 60 minutes. When the coating layer of the coating composition (A) has not been cured, the uncured coating layers of the coating compositions (A) and (B) are simultaneously cured by heating under the above conditions.

The clear coating composition (C) may be the same as or different from the clear coating composition (B), and is applied using a coater such as a rotary electrostatic coater, air spray coater, airless spray coater or the like. The thickness of the coating layer of the clear coating composition (C) is preferably about 15 to about 55 μm (when cured), and more preferably about 25 to about 40 μm.

In step (4), the three-layer coating comprising the base coating composition (A), clear coating composition (B) and clear coating composition (C) is heated to obtain a cured three-layer coating film. It is usually suitable to perform heat curing at about 60 to about 210° C., and preferably about 100 to about 180° C., for about 10 to about 60 minutes.

When the coating layers of the base coating composition (A) and clear coating composition (B) have already been cured in step (3), only the uncured coating layer of the clear coating composition (C) is cured in step (4). In this case, method II is a three-coat two-bake method. When neither of the coating layers of the base coating composition (A) and clear coating composition (B) has been cured, the uncured coating layers of the base coating composition (A), clear coating composition (B) and clear coating composition (C) are simultaneously cured. In this case, method II is a three-coat one-bake method.

A desired luster multilayer coating film is thus formed on a substrate.

EFFECTS OF THE INVENTION

The method of the present invention has a remarkable effect of making it possible to form a luster multilayer coating film with a highly dense texture and high flip-flop property on a substrate such as an automotive body or the like, using an aqueous luster base coating composition.

Such an effect is achieved presumably because three to five uncured thin coats, in which a flaky luster pigment is uniformly orientated parallel to the surfaces of the coats, are superimposed by applying the aqueous luster thermosetting base coating composition (A) in three to five stages in such a manner that the thickness of the composition applied in each stage becomes a predetermined value.

BEST MODE OF CARRYING OUT THE INVENTION

The following Production Examples, Examples and Comparative Examples are provided to illustrate the present invention in further detail. In these examples, parts and percentages are by weight.

Production of Acrylic Resin Emulsion

PRODUCTION EXAMPLE 1

One hundred and forty parts of deionized water, 2.5 parts of a 30% aqueous solution of a surfactant (tradename "Newcol 707SF", product of Nippon Nyukazai Co., Ltd.) and 1 part of the monomer mixture (1) shown below were placed in a reactor and mixed by stirring under a nitrogen stream, followed by the addition of 3 parts of 3% ammonium persulfate at 60° C. The resulting mixture was then heated to 80° C., and a monomer emulsion consisting of 79 parts of monomer mixture (1), 2.5 parts of a 30% aqueous solution of a surfactant (tradename "Newcol 707SF", product of Nippon Nyukazai Co., Ltd.), 4 parts of 3% ammonium persulfate and 42 parts of deionized water was added to the reactor over 4 hours using a metering pump. After addition, the resulting mixture was aged for 1 hour.

Further, 20.5 parts of the monomer mixture (2) shown below and 4 parts of a 3% aqueous solution of ammonium persulfate were added concurrently and dropwise to the reactor over 1.5 hours. After addition, the resulting mixture was aged for 1 hour, diluted with 30 parts of deionized water and filtered through 200-mesh nylon cloth at 30° C. Deionized water was further added to the filtrate, and the pH was adjusted to 7.5 with dimethylaminoethanolamine to thereby obtain an acrylic resin emulsion with a mean particle size of 0.1 μm and a solids content of 20%. The acrylic resin had a hydroxy value of 15 mgKOH/g.

Monomer mixture (1): a mixture of 55 parts of methyl methacrylate, 8 parts of styrene, 9 parts of n-butyl acrylate, 5 parts of 2-hydroxyethyl acrylate, 2 parts of 1,6-hexanediol diacrylate and 1 part of methacrylic acid.

Monomer mixture (2): a mixture of 5 parts of methyl methacrylate, 7 parts of n-butyl acrylate, 5 parts of 2-ethylhexyl acrylate, 3 parts of methacrylic acid and 0.5 parts of a 30% aqueous solution of a surfactant (tradename "Newcol 707SF", product of Nippon Nyukazai Co., Ltd.).

Production of Polyurethane Resin Emulsion

PRODUCTION EXAMPLE 2

In a polymerization reactor, 115.5 parts of polybutylene adipate with a number average molecular weight of 2,000, 115.5 parts of polycaprolactone diol with a number average molecular weight of 2,000, 23.2 parts of dimethylolpropionic acid, 6.5 parts of 1,4-butanediol and 120.1 parts of 1-isocyanato-3-isocyanatomethyl-3,5,5-trimethylcyclohexane were placed and reacted while stirring in a nitrogen gas atmosphere at 85° C. for 7 hours to obtain an NCO-terminated prepolymer with an NCO content of 4.0%.

The prepolymer was then cooled to 50° C., and 165 parts of acetone was added to form a homogeneous solution. While stirring, 15.7 parts of triethylamine was added, and 600 parts of ion exchange water was added while maintaining the temperature at 50° C. or lower. After maintaining the temperature at 50° C. for 2 hours to complete the water extension reaction, the acetone was distilled off under reduced pressure at 70° C. to obtain a polyurethane resin emulsion with a solids content of 42%.

Preparation of Crosslinking Agent

PRODUCTION EXAMPLE 3

(1) Sixty parts of ethylene glycol monobutyl ether and 15 parts of isobutyl alcohol were placed in a reactor, and heated to 115° C. under a nitrogen stream. When the mixture had been heated to 115° C., a mixture of 26 parts of n-butyl acrylate, 47 parts of methyl methacrylate, 10 parts of styrene, 10 parts of 2-hydroxyethyl methacrylate, 6 parts of acrylic acid and 1 part of azoisobutyronitrile was added over 3 hours. After completion of addition, aging was performed at 115° C. for 30 minutes, and a mixture of 1 part of 2,2'-azobisisobutyronitril and 115 parts of ethylene glycol monobutyl ether was added over 1 hour. After aging for 30 minutes, the resulting mixture was filtered through 200-mesh nylon cloth at 50° C. The obtained reaction product had an acid value of 48 mgKOH/g, a viscosity of $Z_4$ (Gardner bubble viscometer) and a nonvolatile content of 55%. The reaction product was neutralized with an equivalent amount of dimethylaminoethanol, followed by the addition of deionized water, to obtain a 50% aqueous solution of an acrylic resin.

(2) In a stirring container, 41.7 parts of butyl etherified melamine resin (tradename "U-Van 28SE", product of Mitsui Chemicals, Inc., nonvolatile content: 60%) was placed as a hydrophobic melamine resin, and 20 parts of the aqueous acrylic resin solution obtained in (1) above was added. Eighty parts of deionized water was gradually added while stirring with an agitating blade mixer at an rpm of 1,000 to 1,500. Stirring was continued for another 30 minutes to thereby obtain an aqueous dispersion of a crosslinking agent with a solids content of about 20% and a mean particle diameter of 0.11 μm.

Production of Aqueous Luster Thermosetting Base Coating Composition (A)

PRODUCTION EXAMPLE 4

Three hundred and twenty five parts of the acrylic resin emulsion with a solids content of 20% obtained in Production Example 1, 35.7 parts of the polyurethane resin emulsion with a solids content of 42% obtained in Production Example 2, and 100 parts of the crosslinking agent dispersion with a solids content of 20% obtained in Production Example 3 were mixed. Twenty-six parts of paste-form aluminum flake pigment (tradename "Alpaste MH-6601"; product of Asahi Chemical Industry Co., Ltd.; a paste with a pigment content of 65%, comprising aluminum flakes with a mean particle diameter of 14.5 μm, a mean thickness of 0.21 μm, and a mean particle diameter/mean thickness ratio of 70, the aluminum flakes being dispersed in a petroleum solvent) was further added, followed by mixing. The resulting mixture was adjusted to a solids content of 15% with deionized water to obtain aqueous luster base coating composition (A-1).

PRODUCTION EXAMPLE 5

The procedure of Production Example 4 was followed except that the paste-form aluminum flake pigment was used in an amount of 23 parts, and that 1 part of carbon black and 2 parts of perylene red (red pigment) were further added, to obtain aqueous luster base coating composition (A-2).

PRODUCTION EXAMPLE 6

The procedure of Production Example 4 was followed except that "Alpaste SAP414P" (tradename of Showa Aluminum Powder K.K.; a paste with a pigment content of 65%, comprising aluminum flakes with a mean particle diameter of 14.6 μm, a mean thickness of 0.32 μm, and a mean particle diameter/mean thickness ratio of 45, the aluminum flakes being dispersed in a petroleum solvent) was used as the paste-form aluminum flake pigment in place of, "Alpaste MH-6601", to obtain aqueous base coating composition (A-3).

PRODUCTION EXAMPLE 7

The procedure of Production Example 6 was followed except that the paste-form aluminum flake pigment was used in an amount of 23 parts, and that 1 part of carbon black and 2 parts of perylene red were further added, to obtain aqueous luster base coating composition (A-4).

Production of Thermosetting Clear Coating Composition (B)

PRODUCTION EXAMPLE 8

(1) A monomer mixture of 20 parts of acrylic acid, 20 parts of styrene, 40 parts of n-butyl acrylate and 20 parts of 4-hydroxy n-butyl acrylate was copolymerized in a standard manner to obtain a carboxy- and hydroxy-containing acrylic resin with a number average molecular weight of 3,500, acid value of 86 mgKOH/g and hydroxy value of 78 mgKOH/g.

(2) A monomer mixture of 30 parts of glycidyl methacrylate, 20 parts of 4-hydroxy n-butyl acrylate, 40 parts of n-butyl acrylate and 20 parts of styrene was copolymerized in a standard manner to obtain an epoxy- and hydroxy-containing acrylic resin with a number average molecular weight of 3,000, epoxy content of 2.1 mmol/g and hydroxyl value of 78 mgKOH/g.

(3) A mixture of 50 parts of the carboxy- and hydroxy-containing acrylic resin obtained (1) above, 50 parts of the epoxy- and hydroxy-containing acrylic resin obtained in (2) above, 1 part of an ultraviolet absorber (tradename "Tinuvin 900", product of Ciba-Geigy), 1 part of tetrabutylammonium bromide and 0.1 part of a surface conditioner (tradename "BYK-300", product of BYK-Chemie) was diluted with an aromatic hydrocarbon solvent (tradename "Swasol #1000", product of Cosmo Oil Co., Ltd.) to adjust the viscosity to 20 seconds (Ford cup #4, 20° C.) and thereby obtain thermosetting clear coating composition (B-1).

Production of Substrate

PRODUCTION EXAMPLE 9

A cationic electrodeposition coating composition (tradename "Elecron 9400HB", product of Kansai Paint Co., Ltd.) was applied by electrodeposition to a degreased and zinc phosphate-treated steel sheet to a thickness of 25 μm (when cured), and heat-cured at 170° C. for 20 minutes. A polyester resin-based intermediate coating composition (tradename "Amilac Intermediate Coat, Gray", product of Kansai Paint Co., Ltd.) was applied by air spraying to the cured electrodeposition coating to a thickness of 35 μm (when cured), heat-cured at 140° C. for 20 minutes to obtain a substrate having an electrodeposition coating and intermediate coating.

EXAMPLE 1

Aqueous luster base coating composition (A-1) obtained in Production Example 4 was applied in four stages to the substrate obtained in Production Example 9, using a Metabell rotary electrostatic coater at 30,000 rpm, shaping pressure of 1.7 kg/cm$^2$, gun distance of 30 cm, booth temperature of 20° C. and booth humidity of 75%, in such a manner that the thickness of the coating composition applied in each stage became about 3 μm (when cured) and the total thickness of the coating composition applied in the four stages became 12 μm (when cured). The applied coating composition was allowed to stand for one minute between the stages. The solids content of the applied composition one minute after the application in each stage was 55%.

After the four stages of application, the applied composition was allowed to stand for 3 minutes and preheated at 80° C. for 10 minutes. Clear coating composition (B-1) was applied over the uncured coating layer of base coating composition (A-1) to a thickness of 30 μm (when cured), using a Minibell rotary electrostatic coater at 30,000 rpm, shaping pressure of 1.5 kg/cm$^2$, gun distance of 30 cm, booth temperature of 20° C. and booth humidity of 75%, allowed to stand for 7 minutes, and heated at 140° C. for 30 minutes to simultaneously cure the two uncured coating layers of base coating composition (A-1) and clear coating composition (B-1).

A coated sheet was thus obtained in which a luster two-layer coating film was formed on a substrate by a two-coat one-bake method.

EXAMPLE 2

The procedure of Example 1 was followed except for using aqueous luster base coating composition (A-2) in place of aqueous luster base coating composition (A-1), to obtain a coated sheet. The solids content of aqueous luster base coating composition (A-2) one minute after the application in each stage was 55%.

EXAMPLE 3

Aqueous luster base coating composition (A-3) was applied in four stages to a substrate obtained in Production Example 9, using a Metabell rotary electrostatic coater at 30,000 rpm, shaping pressure of 1.7 kg/cm$^2$, gun distance of 30 cm, booth temperature of 20° C. and booth humidity of 75%, in such a manner that the thickness of the coating composition applied in each stage became about 3.5 μm (when cured) and the total thickness of the coating composition applied in the four stages became 14 μm (when cured). The applied coating composition was allowed to stand for one minute between the stages. The solids content of the applied composition one minute after the application in each stage was 50%.

After the four stages of application, the applied composition was allowed to stand for 3 minutes and preheated at 80° C. for 10 minutes. Clear coating composition (B-1) was applied to the uncured coating layer of base coating composition (A-3) to a thickness of 30 μm (when cured), using a Minibell rotary electrostatic coater at 30,000 rpm, shaping pressure of 1.5 kg/cm$^2$, gun distance of 30 cm, booth temperature of 20° C. and booth humidity of 75%, allowed to stand for 7 minutes, and heated at 140° C. for 30 minutes to simultaneously cure the two uncured coating layers of base coating composition (A-3) and clear coating composition (B-1).

A coated sheet was thus obtained in which a luster two-layer coating film was formed on a substrate by a two-coat one-bake method.

EXAMPLE 4

The procedure of Example 3 was followed except for using aqueous luster base coating composition (A-4) in place of aqueous luster base coating composition (A-3), to obtain a coated sheet.

The solids content of aqueous luster base coating composition (A-4) one minute after the application in each stage was 50%.

COMPARATIVE EXAMPLE 1

The procedure of Example 1 was followed except that aqueous luster base coating composition (A-1) was applied in two stages in such a manner that the thickness of the coating composition applied in each stage became about 6 μm (when cured) and the total thickness of the coating composition applied in the two stages became 12 μm (when cured).

COMPARATIVE EXAMPLE 2

The procedure of Example 1 was followed except that aqueous luster base coating composition (A-1) was applied in three stages in such a manner that the thickness of the coating composition applied in each stage became about 6 μm (when cured) and the total thickness of the coating composition applied in the three stages became 18 μm.

COMPARATIVE EXAMPLE 3

The procedure of Example 3 was followed except that aqueous luster base coating composition (A-3) was applied in two stages in such a manner that the thickness of the coating composition applied in each stage became about 7 μm (when cured) and the total thickness of the coating composition applied in the two stages became 14 μm (when cured).

EXAMPLE 5

Aqueous luster base coating composition (A-1) was applied in three stages to the substrate obtained in Production Example 9, using a Metabell rotary electrostatic coater at 30,000 rpm, shaping pressure of 1.7 kg/cm$^2$, gun distance of 30 cm, booth temperature of 20° C. and booth humidity of 75%, in such a manner that the thickness of the coating composition applied in the first stage became about 6 μm (when cured), and the thickness of the coating composition applied in each of the second and third stages became about 3 μm (when cured), and the total thickness of the coating composition applied in the three stages became 12 μm (when cured). The applied coating composition was allowed to stand for one minute between the stages.

The solids content of the applied composition one minute after the application in the first stage was 40%, and the solids contents of the applied composition one minute after the application in the second and third stages were each 55%.

After the three stages of application, the applied composition was allowed to stand for 3 minutes and preheated at 80° C. for 10 minutes. Clear coating composition (B-1) was applied to the uncured coating layer of base coating composition (A-1) to a thickness of 30 μm (when cured), using a Minibell rotary electrostatic spray coater at 30,000 rpm, shaping pressure of 1.5 kg/cm$^2$, gun distance of 30 cm, booth temperature of 20° C. and booth humidity of 75%. The applied composition was allowed to stand for 7 minutes, and heating was performed at 140° C. for 30 minutes to simultaneously cure the two uncured coating layers of base coating composition (A-1) and clear coating composition (B-1).

A coated sheet was thus obtained in which a luster two-layer coating film was formed on a substrate by a two-coat one-bake method.

EXAMPLE 6

The procedure of Example 5 was followed except for using aqueous luster base coating composition (A-2) in place of aqueous luster base coating composition (A-1), to obtain a coated sheet.

The solids content of the applied aqueous luster base coating composition (A-2) one minute after the application in the first stage was 40%, and the solids contents of the applied coating composition (A-2) one minute after the application in the second and third stages were each 55%.

EXAMPLE 7

Aqueous luster base coating composition (A-3) was applied in four stages to the substrate obtained in Production Example 9, using a Metabell rotary electrostatic coater at 30,000 rpm, shaping pressure of 1.7 kg/cm$^2$, gun distance of 30 cm, booth temperature of 20° C. and booth humidity of 75%, in such a manner that the thickness of the coating composition applied in the first stage became about 5 μm (when cured), the thickness of the coating composition applied in each of the second and subsequent stages became about 2.5 μm, and the total thickness of the coating composition applied in the four stages became 12.5 μm (when cured). The applied coating composition was allowed to stand for one minute between the stages.

The solids content of the applied composition one minute after the application in the first stage was 45%, and the solids contents of the applied composition one minute after the application in the second, third and fourth stages were each 60%.

After the four stages of application, the applied composition was allowed to stand for 3 minutes and preheated at 80° C. for 10 minutes. Clear coating composition (B-1) was applied over the uncured coating layer of base coating composition (A-3) to a thickness of 30 μm (when cured), using a Minibell rotary electrostatic spray coater at 30,000 rpm, shaping pressure of 1.5 kg/cm$^2$, gun distance of 30 cm, booth temperature of 20° C. and booth humidity of 75%. The applied composition was allowed to stand for 7 minutes, and heating was performed at 140° C. for 30 minutes to simultaneously cure the two uncured coating layers of base coating composition (A-3) and clear coating composition (B-1).

A coated sheet was thus obtained in which a luster two-layer coating film was formed on a substrate by a two-coat one-bake method.

EXAMPLE 8

The procedure of Example 7 was followed except for using aqueous luster base coating composition (A-4) in place of aqueous luster base coating composition (A-3), to obtain a coated sheet.

The solids content of the applied aqueous luster base coating composition (A-4) one minute after the application in the first stage was 45%, and the solids contents of the applied coating composition (A-4) one minute after the application in the second, third and fourth stages were each 60%.

COMPARATIVE EXAMPLE 4

The procedure of Example 7 was followed except that aqueous luster base coating composition (A-3) was applied in two stages in such a manner that the thickness of the coating composition applied in the first stage became about 9 μm (when cured), the thickness of the coating composition applied in the second stage became about 3.5 μm (when cured), and the total thickness of the coating composition applied in the two stages became 12.5 μm (when cured).

Performance Evaluation Tests

The coated sheets obtained in Examples 1 to 8 and Comparative Examples 1 to 4 were tested for density of texture and flip-flop property by the following methods.

Density of texture: The highlight of the coating surface of each coated sheet was observed by the naked eye, and evaluated according to the following criteria. A: The coating surface was only slightly grainy and had a highly dense texture; B: The coating surface was very grainy and had a poor density of texture.

As another evaluation of the density of texture, the HG (Highlight Graininess) value of the coating surface of each coated sheet was measured using a micro-brilliance measuring instrument (product of Kansai Paint Co., Ltd.). The micro-brilliance measuring instrument is equipped with a light source, a CCD (Charge Coupled Device) camera and an image analyzer, and is disclosed in Japanese Unexamined Patent Publication No. 2001-221690.

The HG value is a parameter of micro-brilliance obtained by microscopic observation of a coating surface, and indicates the graininess of the highlight of the coating surface. The HG value is calculated as follows.

First, the coating surface is photographed with a CCD camera at a light incidence angle of 15° and receiving angle of 0°, and the obtained digital image data (two-dimensional brilliance distribution data) is subjected to two-dimensional Fourier transformation to obtain a power spectrum image. Subsequently, the spatial frequency area corresponding to graininess is extracted from the power spectrum image, and the obtained measurement parameter is converted to an HG value from 0 to 100 that has a linear relation with graininess.

An HG value of 0 indicates no graininess of the luster pigment at all, and an HG value of 100 indicates the highest possible graininess of the luster pigment.

Flip-flop property: The highlight and shade of the coating surface of each coated sheet were observed by the naked eye, and evaluated according to the following criteria. A: A large difference in brightness between the highlight and shade; B: A small difference in brightness between the highlight and shade; C: Almost no difference in brightness between the highlight and shade.

Further, using a multi-angle spectrocolorimeter (tradename "MA68II", product of X-Rite in the U.S.), the color of the coating surface of each coated sheet was determined, and the reflectance at receiving angles of 15° and 110° from the regular reflection light was measured at a light incidence angle of 45°. The ratio of the reflectance at a receiving angle of 15° to that at a receiving angle of 110° (FF value) was calculated. The higher the FF value, the higher the flip-flop property.

Table 1 shows the results of the evaluation tests of density of texture and flip-flop property.

Table 1 reveals that the method of the present invention is capable of forming on a substrate a luster multilayer coating film with a highly dense texture and excellent flip-flop property.

The invention claimed is:

1. A method of forming a luster coating film, comprising the steps of:

(1) applying an aqueous luster thermosetting base coating composition (A), the solids content of the base coating composition (A) being about 5 to about 15 wt. % to a substrate in four or five stages, in such a manner that the thickness of the base coating composition (A) applied in the first stage becomes 1 to 5 μm when cured, the thickness of the base coating composition (A) applied in each of the second and subsequent stages becomes 0.3 to 5 μm when cured, and the total thickness of the base coating composition (A) applied in all of the stages in step (1) is 10 to 15 μm when cured;

(2) applying a thermosetting clear coating composition (B) over the uncured or heat-cured coating layer of the base coating composition (A); and (3) heating the two-layer coating comprising the base coating composition (A) and clear coating composition (B) to obtain a cured two-layer coating film;

wherein, in step (1), the solids content of the aqueous luster thermosetting base coating composition (A) one minute after the application in each stage is at least 40 wt. %; and wherein, in step (1), after each coating stage, the applied composition is allowed to stand, or is preheated at about 50 to about 80° C.

2. The method according to claim 1, wherein the aqueous luster thermosetting base coating composition (A) comprises a water-soluble or water-dispersible, crosslinkable functional group-containing resin, a crosslinking agent and a flaky luster pigment.

3. The method according to claim 1, wherein the substrate is an automotive body or a part thereof.

4. An automotive body or part thereof having a luster coating film formed by the method according to claim 3.

5. A method of forming a luster coating film, comprising the steps of:

(1) applying an aqueous luster thermosetting base coating composition (A), the solids content of the base coating composition (A) being about 5 to about 15 wt. % to a substrate in four or five stages, in such a manner that the thickness of the base coating composition (A) applied in the first stage becomes 1 to 5 μm when cured, the thickness of the base coating composition (A) applied in each of the second and subsequent stages becomes 0.3 to 5 μm when cured, and the total thickness of the base coating composition (A) applied in all of the stages in step (1) is 10 to 15 μm when cured;

TABLE 1

| | | Example | | | | | | | | Comp. Ex. | | | |
|---|---|---|---|---|---|---|---|---|---|---|---|---|---|
| | | 1 | 2 | 3 | 4 | 5 | 6 | 7 | 8 | 1 | 2 | 3 | 4 |
| Density of texture | Naked eye observation | A | A | A | A | A | A | A | A | B | B | B | B |
| | HG value | 45 | 42 | 48 | 45 | 46 | 43 | 49 | 47 | 57 | 60 | 63 | 61 |
| Flip-flop property | Naked eye observation | A | A | A | A | A | A | A | A | C | C | C | B |
| | FF value | 1.8 | 1.8 | 1.9 | 1.9 | 1.7 | 1.8 | 1.8 | 1.9 | 1.3 | 1.2 | 1.4 | 1.5 |

(2) applying a thermosetting clear coating composition (B) over the uncured or heat-cured coating layer of the base coating composition (A);

(3) applying a thermosetting clear coating composition (C) over the uncured or heat-cured coating layer of the clear coating composition (B); and (4) heating the three-layer coating comprising the base coating composition (A), clear coating composition (B) and clear coating composition (C) to obtain a cured three-layer coating film;

wherein, in step (1), the solids content of the aqueous luster thermosetting base coating composition (A) one minute after the application in each stage is at least 40 wt. %; and wherein, in step (1), after each coating stage, the applied composition is allowed to stand, or is preheated at about 50 to about 80° C.

6. The method according to claim 5, wherein the aqueous luster thermosetting base coating composition (A) comprises a water-soluble or water-dispersible, crosslinkable functional group-containing resin, a crosslinking agent and a flaky luster pigment.

7. The method according to claim 5, wherein the substrate is an automotive body or a part thereof.

8. An automotive body or part thereof having a luster coating film formed by the method according to claim 7.

* * * * *